US012187398B2

(12) United States Patent
Bredda

(10) Patent No.: US 12,187,398 B2
(45) Date of Patent: Jan. 7, 2025

(54) MARINE PROPULSION SYSTEM

(71) Applicant: Caudwell Marine Limited, Eccleshall (GB)

(72) Inventor: Scott Bredda, Leighton Buzzard (GB)

(73) Assignee: Caudwell Marine Limited, Stafford (GB)

( * ) Notice: Subject to any disclaimer, the term of this patent is extended or adjusted under 35 U.S.C. 154(b) by 0 days.

(21) Appl. No.: 18/492,219

(22) Filed: Oct. 23, 2023

(65) Prior Publication Data

US 2024/0051651 A1 Feb. 15, 2024

Related U.S. Application Data

(63) Continuation of application No. 17/318,888, filed on May 12, 2021, now Pat. No. 11,827,326.

(30) Foreign Application Priority Data

May 12, 2020 (GB) ..... 2006977

(51) Int. Cl.

| | |
|---|---|
| ***B63H 20/22*** | (2006.01) |
| ***B63H 20/00*** | (2006.01) |
| ***B63H 20/12*** | (2006.01) |
| ***B63H 20/18*** | (2006.01) |
| ***B63H 23/32*** | (2006.01) |

(52) U.S. Cl.

CPC ..... *B63H 20/22* (2013.01); *B63H 20/002* (2013.01); *B63H 20/12* (2013.01); *B63H 20/18* (2013.01); *B63H 23/321* (2013.01)

(58) Field of Classification Search

CPC ..... B63H 20/22; B63H 20/002; B63H 20/12; B63H 20/18; B63H 23/321

See application file for complete search history.

(56) References Cited

U.S. PATENT DOCUMENTS

| | | | | |
|---|---|---|---|---|
| 3,310,021 A | | 3/1967 | Shimanckas | |
| 3,765,370 A | | 10/1973 | Shimanckas | |
| 4,562,797 A | * | 1/1986 | Suzuki | F02B 75/20 123/90.34 |
| 5,934,960 A | * | 8/1999 | Katayama | B63H 20/245 440/89 C |

FOREIGN PATENT DOCUMENTS

| | | | |
|---|---|---|---|
| CN | 105005298 B | | 10/2018 |
| EP | 0705966 A1 | | 4/1996 |
| JP | 2019519436 A | * | 7/2019 |
| WO | 2012101484 A1 | | 8/2012 |
| WO | 2015189808 A1 | | 12/2015 |
| WO | 2019110685 A1 | | 6/2019 |

OTHER PUBLICATIONS

International Search Report for PCT/GB2021/051142, Sep. 3, 2021, 2 pages.

* cited by examiner

*Primary Examiner* — Stephen P Avila

(74) *Attorney, Agent, or Firm* — Bookoff McAndrews, PLLC

(57) ABSTRACT

An outboard propulsion system comprising an engine configured to receive oil; an oil pan configured to receive oil from the engine; and an oil reservoir configured to receive oil from the oil pan and provide oil to the engine, in use.

19 Claims, 6 Drawing Sheets

MARINE PROPULSION SYSTEM

This patent application is a continuation of U.S. application Ser. No. 17/318,888, filed on May 12, 2021, which claims the benefit of priority to GB Patent Application No. GB2006977.9, filed on May 12, 2020, the entirety of each of which is incorporated herein by reference.

The present invention relates to improvements in or relating to a marine propulsion system and, more specifically, to an outboard propulsion system.

A conventional outboard propulsion system is a self-contained unit that can be fitted on the transom of a boat, the system comprising an engine, transmission and propeller (or jet drive). The entire unit can rotate relative to the transom about a vertical steering axis, to control the direction of thrust from the propeller and thus steer the boat. The entire unit can also be rotated relative to the transom about a transverse, horizontal trim/tilt axis, to trim the angle of attack of the thrust and/or to tilt the unit up, e.g. when not in use.

The conventional configuration of an outboard motor includes a powerhead comprising an engine. The powerhead is typically provided with a vertical crankshaft, although horizontal crankshafts have also been used. A drive shaft extends vertically from the powerhead into a mid-section that typically houses an oil sump and RAW water and exhaust passages. The mid-section may also house parts of the gearbox. A lower unit houses gears configured to transmit power from the vertical drive shaft to a horizontal propeller shaft. The powerhead, mid-section and lower unit are attached to form a single unit that rotates about the steering axis and trim/tilt axis, as described above.

The configurations of these propulsion systems include one or more complicated attachments to the boat's transom, comprising a hydraulic system, that allows the entire propulsion system to rotate about its steering axis and its trim/tilt axis. The complication is partly due to the multiplicity of rotation axes and partly because the entire system needs to rotate about these axes. Rotating the powerhead can require large forces and require adequate space around the transom of the boat for the powerhead to rotate about the steering axis. In order to accommodate these rotational movements, the powerhead is usually supported well aft of the transom. Consequently, many traditional outboard motors comprise a steering lever that extends within the hull of the boat. This lever is attached to the powerhead and is used to rotate the motor relative to the transom to steer the boat. The lever requires adequate space to rotate and takes up valuable space within the hull of the boat.

Furthermore, traditional outboard propulsion systems offer a limited speed at which a boat can perform a sharp turn. As a boat banks into a corner, the change in the angle of the transom may cause the propeller of the outboard propulsion system to be lifted out of the water which can significantly reduce the speed of the boat. This issue is compounded by the substantially horizontal and planar motion of a traditional propeller shaft when turning. To counteract this effect, the outboard propulsion system, including the propeller shaft, is required to be trimmed down before commencing the turn to prevent the propeller from breaking the water surface.

It is against this background that the present invention has arisen.

According to the present invention, there is provided an outboard propulsion system comprising: a first portion for attachment to a boat comprising a stern, the first portion comprising an engine including a crankshaft; and a second portion comprising at least one propeller shaft having a longitudinal axis along the elongate length of the at least one propeller shaft, wherein the at least one propeller shaft is operably connected to the crankshaft, wherein the second portion is configured to pivot relative to the first portion about a steering axis, wherein the steering axis intersects the longitudinal axis of the at least one propeller shaft at an obtuse angle, wherein the first portion and second portion are configured to tilt together about a single axis of rotation substantially parallel to the stern of the boat, and wherein the first portion is fixed about a substantially vertical axis.

A propulsion system comprising a first portion that is fixed about a substantially vertical axis prevents the first portion and/or engine from rotating or pivoting about the stern of the boat. This significantly reduces the amount of space that would otherwise be required around the first portion in order to allow such movement. Furthermore, the entire outboard propulsion system can be located closer to the stern of the boat and a more robust and/or simplified attachment means can be utilised for attaching the first portion to the boat. This is because the number of degrees of freedom through which the first portion can move is reduced compared to traditional outboard motors and therefore the complexity of the joint is also reduced. Each of these factors may enable a larger and/or more powerful engine to be used for a given overall system size, otherwise known as the 'packaging' size. Alternatively, or in addition, each of these factors may enable a smaller packaging size for a given engine. Note that in the present context, the term packaging size comprises the size of the entire propulsion system in addition to the space required within which it moves or rotates in a standard usage cycle.

Moreover, allowing the first and second portions to tilt together about a single axis of rotation that is substantially parallel to the stern of the boat enables the entire second portion to be raised out of the water. This may be necessary during maintenance of the system, for example. In some embodiments, the stern of the boat may be curved and/or the first portion and second portion may tilt together about a single, curved axis of rotation. Alternatively, or in addition, the first portion and second portion may be configured to tilt together about a single axis substantially perpendicular to the longitudinal axis of the boat. In some embodiments, the first and second portion may comprise a single degree of freedom when being tilted together.

Furthermore, allowing the first portion and second portion to tilt together about a single axis of rotation substantially parallel to the stern of the boat may enable the at least one propeller shaft to trim up and/or down. This allows a user to raise or lower the bow of the boat, which effects the boat's performance (speed and handling), and fuel economy (due to drag).

An obtuse angle between the steering axis and the longitudinal axis of the at least one propeller shaft enables the engine to be located at an acute angle relative to a longitudinal axis of the boat. It also enables the engine to be located at an acute angle relative to a substantially vertical axis. The aforementioned arrangements enable a traditional horizontal engine to be used, thus enabling a reliable, highly efficient and robust engine design to be used. In some embodiments, the traditional horizontal engine may require alterations to optimise the system.

The obtuse angle between the longitudinal axis of the at least one propeller shaft and the steering axis may result in the thrust vector comprising an upward component to be generated by the outboard propulsion system. For example, the at least one propeller shaft may comprise a proximal end and a distal end, wherein the proximal end is located closer to the engine than the distal end. The at least one propeller shaft may further comprise at least one propeller located closer to the distal end than the proximal end. When the second portion is rotated relative to the first portion, the obtuse angle between the steering axis and the propeller axis causes a distal end of the propeller axis to lower relative to a proximal end, hence causing the thrust vector generated by the at least one propeller, in use, to comprise an upward component. This movement reduces the likelihood of the at least one propeller breaking the water surface during a turn. Furthermore, this movement lowers the bow of the boat and reduces the likelihood of the boat skidding across the water surface during a turn.

Moreover, fixing the first portion to the boat and allowing relative movement of the second portion gives a significant advantage when manoeuvring a twin outboard boat sideways, for example, when docking and/or undocking as well as any other off-plane manoeuver. As is commonly known in the boating industry, the propellers on each of the outboard propulsion system of a twin outboard boat are turned to oppose each other as a part of this common manoeuver. Fixing the first portions therefore significantly reduces the likelihood of the systems touching or crashing into each other during the manoeuver.

Fixing the first portion to the boat also reduces, and/or, in some embodiments, eliminates the number of moving components in the vicinity of the boat. The lack of moving parts around the transom of the boat is safer for passengers and crew.

In some embodiments, the outboard propulsion system may be electric. The outboard propulsion system may comprise a first portion for attachment to a boat comprising a stern, the first portion comprising at least one electric motor; and a second portion comprising at least one propeller shaft having a longitudinal axis along the elongate length of the shaft, wherein the at least one propeller shaft is operably connected to the electric motor, wherein the second portion is configured to pivot relative to the first portion about a steering axis, wherein the steering axis intersects the longitudinal axis of the at least one propeller shaft at an obtuse angle, wherein the first portion and second portion are configured to tilt together about a single axis of rotation substantially parallel to the stern of the boat, and wherein the first portion is fixed about a substantially vertical axis.

Providing a fully electric outboard propulsion system removes the carbon emissions of the system, in use, and significantly reduces the impact of the system on the environment. An electric motor may also reduce the amount of noise created by the system, in use, and may enable the outboard propulsion system to be used in locations where a non-electric system may not be allowed to be used.

Furthermore, an outboard propulsion system comprising electric motor may provide more torque than an outboard propulsion system comprising an internal combustion engine. An electric system may also provide a predetermined amount of torque more quickly than a system comprising an internal combustion engine. This improved torque output may be utilized more effectively by the present outboard propulsion system as a result of the upward component of the thrust vector. In addition, the improved torque output may be more efficiently used to generate thrust within an outboard propulsion system comprising a plurality of propeller shafts. Thus, an electric motor may result in improved dynamics when compared to outboard propulsion systems with an internal combustion engine.

In embodiments where the outboard propulsion system is electric, the system will further comprise at least one battery. Providing a battery enables the system to obtain its electricity from a more efficient source, such as the national grid. The energy can then be stored in the battery and used at a later time, for example when the boat and outboard system attached thereto is located in a body of water such as a lake or the ocean.

The outboard propulsion system may further comprise a fixing mechanism configured to attach the first portion to the stern of the boat, wherein the fixing mechanism may be configured to permit only a single axis of rotation substantially parallel to the stern of the boat.

Alternatively, or in addition, the fixing mechanism may comprise a single degree of freedom.

A fixing mechanism permitting only a single axis of rotation and/or a single degree of freedom enables the connection between the first portion and the boat to be stronger and more robust. Additional supports and more durable connections can be incorporated into the fixing mechanism to support the first portion where they otherwise would not be possible. As a result, a heavier, bigger and/or more powerful engine may be used.

The fixing mechanism may comprise a cradle and a transom bracket.

The transom bracket may be configured to fix to the stern of the boat and may be configured to prevent relative movement therebetween. Doing so provides a strong and robust unit for connection to the cradle.

The cradle may be fixed to the first portion and may be configured to prevent relative movement therebetween. Fixing the cradle to the first portion such that there is no relative movement therebetween enables a robust connection to be made between the first portion and cradle.

The fixing mechanism may further comprise at least one pad located between the cradle and the first portion, wherein the at least one pad is configured to reduce the transfer of vibrational energy between the first portion and the cradle.

Reducing the transfer of vibrational energy between the first portion and the cradle reduces the strain placed on the transom bracket and its connections. It also results in a smoother and quieter ride for occupants of the boat. The at least one pad may be at least one rubber pad. The fixing mechanism may comprise 1, 2, 3, 4, 5, 8, 10 or more than 10 pads.

The cradle may be connected to the transom bracket, wherein the connection between the cradle and the transom bracket may be configured to permit only a single axis of rotation substantially parallel to the stern of the boat.

Permitting only a single axis of rotation between the cradle and the transom bracket substantially parallel to the stern of the boat prevents the first portion from rotating and/or pivoting about a substantially vertical axis. This prevents additional space being required around the stern of the boat and enables the centre of mass of the engine to be located closer to, or even within the hull of the boat.

The engine may comprise a crankcase. The crankshaft may be located within the crankcase. The outboard propulsion system may further comprise at least one drive shaft operably connected between the crankshaft and the at least one propeller shaft and configured to transmit motive power therebetween. In some embodiments, the outboard propulsion system may comprise a single drive shaft. In some embodiments, the outboard propulsion system may comprise a plurality of drive shafts. Preferably, the outboard propulsion system comprises between two (2) and five (5) drive shafts (inclusive).

Providing at least one drive shaft located between the crankshaft and the at least one propeller shaft enables the centre of mass of the system to be optimised. In addition, the location of specific components relative to each other, the boat and/or the water surface may also be optimised. Furthermore, providing at least one drive shaft located between the crankshaft and the at least one propeller shaft may enable a transmission/gear assembly to be incorporated into the system, for example.

In some embodiments, the at least one drive shaft may be operably connected to the at least one propeller shaft via a first bevel gear. In some embodiments, a single drive shaft may be operably connected to the at least one propeller shaft via a first bevel gear. However, in some embodiments, a plurality of drive shafts may be operably connected to the at least one propeller shaft via a first bevel gear.

Connecting the at least one drive shaft to the at least one propeller shaft using a first bevel gear minimises the number of components and results in a lighter system.

The at least one drive shaft may comprise a drop shaft, wherein the drop shaft may be substantially perpendicular to the at least one propeller shaft. In some embodiments, there may be a plurality of drive shafts and one of the plurality of drive shafts may be a drop shaft. In some embodiments, there may be a plurality of drive shafts and at least one of the plurality of drive shafts may be an intermediate shaft. In some embodiments, there may be one drop shaft and one intermediate shaft. In some embodiments, there may be one drop shaft and a plurality of intermediate shafts. In some embodiments, the at least one drive shaft may comprise a first intermediate shaft.

In some embodiments, the at least one drive shaft may comprise a first intermediate shaft and a second intermediate shaft. In some embodiments, the at least one drive shaft may comprise a first intermediate shaft, a second intermediate shaft and a drop shaft.

The drop shaft may be operably connected between a first intermediate shaft and the at least one propeller shaft. Alternatively, the drop shaft may be operably connected between a second intermediate shaft and the at least one propeller shaft.

Providing a drop shaft that is substantially perpendicular to the at least one propeller shaft allows the second portion to comprise a conventional lower unit. Thus, a reliable, efficient and relatively cheap conventional lower unit can be used. This reduces manufacturing cost and time, in addition to resulting in a more robust system. Furthermore, providing a drop shaft that is substantially perpendicular to the at least one propeller shaft moves the at least one propeller shaft closer to the fixing mechanism, hence closer to the boat, in use. This moves the centre of mass of the system closer to the boat which reduces the strain placed on the fixing mechanism and improves the handling of the boat, in use.

The first intermediate shaft may be operably connected between the crankshaft and the drop shaft, wherein the first intermediate shaft is operably connected to the drop shaft via a first bevel gear. Alternatively, the second intermediate shaft may be operably connected between the first intermediate shaft and the drop shaft, wherein the second intermediate shaft is operably connected to the drop shaft via the first bevel gear.

Connecting the first or second intermediate shaft to the drop shaft via a first bevel gear provides a lighter and more efficient joint than other types of connections, such as a constant velocity (CV) joint. Furthermore, a bevel gear results in a quieter overall system than the equivalent CV joint.

However, in some embodiments, the bevel gear may be replaced with a universal joint and/or a constant velocity joint. Therefore, the first or second intermediate shaft may be operably connected between the crankshaft and the drop shaft via a constant velocity joint or a universal joint.

The first and/or second intermediate shaft may be substantially parallel to the crankshaft longitudinal axis.

Providing a first or second intermediate shaft that is substantially parallel to the longitudinal axis of the crankshaft limits the number of bevel gears (or equivalents) that are required and hence provides a more efficient system.

The at least one propeller shaft may comprise an inner propeller shaft and an outer propeller shaft, wherein the outer propeller shaft may be hollow and may be configured to receive at least a portion of the inner propeller shaft.

Providing an inner and outer propeller shaft enables a propeller to be connected to each of the inner and outer shafts. The at least two propellers may then independently receive motive power from at least one drop shaft and be configured to provide thrust. The inner and outer propeller shafts may be concentric.

The inner propeller shaft may be operably connected to at least a first propeller and the outer propeller shaft may be connected to at least a second propeller. The first propeller may be located at the distal end of the inner propeller shaft. The second propeller may be located between the first propeller and the proximal end of the inner and outer propeller shafts.

Providing an inner propeller shaft comprising a first propeller and a second propeller shaft comprising a second propeller may increase the efficiency with which torque can be transferred between the drop shaft and each propeller. The resulting system may be more efficient.

The steering axis may extend substantially parallel to the longitudinal axis of the crankshaft.

Locating the steering axis substantially parallel to the longitudinal axis of the crankshaft requires fewer bevel gears within the system. This reduces the number of components which results in a smaller overall system, i.e. a smaller packaging size which is cheaper to manufacture. Furthermore, a smaller system enables the centre of mass to be located closer to the transom of the boat which improves the manoeuvrability.

Alternatively, the steering axis may intersect the longitudinal axis of the crankshaft at an acute angle. This configuration may comprise an additional bevel gear which may be used to optimise the centre of mass of the system. For example, the centre of mass of the system may be moved towards the transom of the boat. The steering axis may intersect the longitudinal axis at an angle between (and including) 0-10 degrees, 10-20 degrees, 20-30 degrees, 30-40 degrees, 40-50 degrees, 50-60 degrees, 60-70 degrees, 70-80 degrees or 80-90 degrees.

The drop shaft may connect to the at least one propeller shaft via at least a second bevel gear. The at least second bevel gear may be a 90 degree bevel gear.

In some embodiments, there may be a plurality of drop shafts. For example, there may be two drop shafts. The two drop shafts may be concentric. Alternatively, the two drop shafts may be parallel. A plurality of drop shafts may transmit motive power between the crankshaft and the at least one propeller shaft more efficiently.

The at least second bevel gear may be operably connected to at least one clutch. A first clutch may be operably connected between a second bevel gear and a first drop shaft, wherein the first clutch is configured to rotate the drop shaft in a first direction. A second clutch may be operably connected between a third bevel gear and a second drop shaft, wherein the second clutch is configured to rotate the second drop shaft in a second direction.

The outboard propulsion system may further comprise a transmission assembly configured to control the motive power provided to the at least one propeller shaft.

Providing a transmission assembly enables the motive power supplied to the at least one propeller shaft to be controlled, adjusted and/or regulated. The speed and direction of the at least one propeller shaft may be controlled, hence enabling a boat to control its speed and direction of travel. The transmission assembly may comprise a reversing gear configured to reverse the rotational direction of the at least one propeller shaft. Further, the transmission assembly may be configured to turn the outboard propulsion system on and/or off in addition to increasing or decreasing the motive powering being output.

The transmission assembly may be located in the first portion.

Locating the transmission assembly in the first portion ensures that the centre of mass of the system remains as close to the cradle and hence the transom of the boat as possible. This reduces the strain placed on the fixing mechanism and may improve the control and handling of the boat, in use.

The drive shaft may comprise a transmission input drive shaft. Alternatively, or in addition, the drive shaft may comprise a transmission output drive shaft. The first intermediate shaft may be the transmission input drive shaft. Alternatively, or in addition, the second intermediate shaft may be the transmission output drive shaft. Conversely, the second intermediate shaft may be operably coupled to the transmission output drive shaft. The first intermediate shaft may be substantially parallel to the second intermediate shaft. Alternatively, or in addition, the second intermediate shaft may be laterally spaced apart from the second intermediate shaft. The transmission assembly may further comprise an offset pair of gears configured to move the second portion closer to the fixing mechanism. The offset pair of gears may comprise a first gear attached to the transmission output shaft and a second gear attached to the second intermediate shaft. The first gear may be configured to engage with the second gear. Consequently, the first gear may transfer motive power to the second gear, in use.

Moving the second portion closer to the fixing mechanism moves the centre of mass of the entire outboard propulsion system closer to the stern of the boat. Doing so reduces the load and hence the moment of force on the fixing mechanism. The reduced moment of force on the fixing mechanism reduces the shock loads on the back of the boat created by the movement of the outboard propulsion system, in use.

The steering axis may intersect the longitudinal axis of the at least one propeller shaft at an angle between 100 degrees and 140 degrees. Alternatively, or in addition, the steering axis may intersect the longitudinal axis of the at least one propeller shaft at an angle of about 120 degrees.

In some embodiments, the steering axis may intersect the propeller axis at an angle between 90 and 180 degrees, 95 and 160 degrees, 100 and 140 degrees, 110 and 130 degrees, 115 and 125 degrees or at about 120 degrees.

Alternatively, or in addition, there is also provided an outboard propulsion system comprising an engine configured to receive oil; an oil pan configured to receive oil from the engine; and an oil reservoir configured to receive oil from the oil pan and provide oil to the engine, in use.

More specifically, there is also provided an outboard propulsion system comprising an engine having a crankshaft located within a crankcase, wherein the crankcase is configured to receive oil; an oil pan configured to receive oil from the crankcase; and an oil reservoir configured to receive oil from the oil pan and provide oil to the engine, in use.

An outboard propulsion system comprising an oil reservoir and an oil pan results in a dry oil sump system. This improves the efficiency of the system as the oil pick-up within the reservoir is more likely to remain below the oil level, in use. Consequently, the outboard propulsion system can continue to deliver oil into the engine during sharp turns, for example. This may increase the power produced by the engine during turns. Moreover, the required oil pressure can therefore be maintained, which can protect the engine from potential damage. In addition, a separate oil reservoir reduces the amount of oil within the engine and oil pan at any given time. This may be used to prevent the crankshaft from contacting oil within the oil pan, in use. This reduces unnecessary drag on the crankshaft and therefore further improves the efficiency of the system.

Moreover, a separate oil reservoir may be positioned in a more favourable position within the outboard propulsion system, thus enabling the weight distribution of the outboard propulsion system to be optimized. A larger oil reservoir may also be used compared to an equivalent wet oil sump system. For example, the crankcase, oil pan and oil reservoir may contain between 5 litres and 12 litres of oil. Alternatively, the engine, oil pan and oil reservoir may contain between 5 litres and 12 litres of oil. Approximately 4 litres to 11 litres may be located in the oil reservoir. Approximately 1 litre to 4 litres may be located in the crankcase and/or oil pan. Alternatively, approximately 1 litre to 4 litres may be located in the engine and/or oil pan.

The oil reservoir may be located adjacent to the engine. For example, the oil reservoir may be located directly adjacent to the engine. Alternatively, or in addition, the oil reservoir may be located above the engine, in use. In some embodiments, the oil reservoir may be located aft of the engine. Alternatively, the oil reservoir may be located fore of the engine. For example, on a boat with a transom, the oil reservoir may be located fore of the engine such that the oil reservoir is positioned between the engine and the transom of the boat, in use. Alternatively, the oil reservoir may be located behind the engine with respect to the boat, in use. Consequently, the location of the oil reservoir may be optimised in order to allow the engine to be positioned closer to the stern of the boat and/or closer to the water level, in use. This results in a more favourable distribution of weight within the outboard propulsion system. Moreover, the location of the oil reservoir may be optimised in order to allow easy access to the reservoir from within a boat to which the outboard propulsion system is attached.

The oil reservoir may be detachable. For example, the oil reservoir may be detachable from the outboard propulsion system. Alternatively, or in addition, the oil reservoir may be removable. For example, the oil reservoir may be entirely removed from the outboard propulsion system. This may allow a first oil reservoir and the oil therein to be replaced with a second oil reservoir comprising fresh oil. This removes the requirement for a user to have to remove a plug within the oil reservoir and drain the oil therefrom. Consequently, the ease with which the system can be maintained is improved.

The outboard propulsion system may further comprise a transmission assembly having an oil transfer pump. The oil transfer pump may be configured to pump oil from the oil pan to the oil reservoir. Locating the oil transfer pump in the transmission assembly improves the overall packaging of the system. Furthermore, the oil transfer pump may utilise an existing shaft within the transmission in order to receive power. This removes the requirement for a separate drive system, such as a belt, chain or gear, thus decreasing the number of components and decreasing the likelihood of a fault within the outboard propulsion system. Finally, the location of the oil transfer pump within the transmission lowers the overall centre of mass of the system compared to traditional outboard propulsion systems. This may improve handling and/or conveniently position the oil transfer pump below the engine and/or crankcase so gravity assists with the draining of oil from the engine and through the crankcase. This increases the efficiency of the pump.

Alternatively, or in addition, the outboard propulsion system may comprise an electric motor configured to provide power to the oil transfer pump. The electric motor may be the oil transfer pump's primary power source. Alternatively, the electric motor may be a backup power source for the oil transfer pump. For example, in some embodiments, an electric motor may be more desirable when the oil reservoir is removable and/or detachable.

Alternatively, or in addition, the oil transfer pump may be configured to receive motive power directly from the transmission assembly. A pump that receives motive power directly from the transmission assembly will reduce the energy losses that may occur when powering the pump via the engine and/or transmission assembly indirectly. The motive power may be in the form of rotational energy.

The transmission assembly may be configured to receive motive power from the engine via at least one drive shaft. Alternatively, or in addition, the transmission assembly may be configured to provide motive power to the oil transfer pump via a pump shaft. The pump shaft may be located within the transmission assembly. Having a pump shaft within the transmission assembly allows the location of the oil transfer pump to be optimized. This may improve the weight distribution and/or handling of the outboard propulsion system.

The pump shaft may be directly connected to the forward gear. Alternatively, or in addition, the pump shaft may be directly connected to the forward clutch. More specifically, the pump shaft may be directly coupled to the forward clutch and/or the forward gear. This reduces the number of components required within the transmission, thus improving the overall packaging and weight of the system.

The transmission assembly may be configured to receive motive power from the crankshaft via at least one drive shaft. The drive shaft between the engine and the transmission may comprise the first intermediate shaft. Consequently, the pump shaft may receive motive power from the crankshaft via the input drive shaft, in use.

The drive shaft may comprise an input drive shaft. The pump shaft may be operably coupled to the crankshaft via the input drive shaft. The input drive shaft may be directly coupled to the crankshaft. The input drive shaft may receive motive power directly from the crankshaft, in use. The output drive shaft may receive motive power from the crankshaft via the input drive shaft, in use. The input drive shaft may be the first intermediate shaft.

The transmission may comprise an output drive shaft. The output drive shaft may be the second intermediate shaft. Alternatively, the output drive shaft may be operably coupled to the second intermediate shaft via the offset pair of gears.

The pump shaft may be configured to rotate constantly when the engine is turned on. Alternatively, or in addition, the pump shaft may be configured to rotate constantly, in use. Having a separate pump shaft within the transmission assembly that is configured to rotate constantly when the engine is turned on ensures that the oil transfer pump is in constant operation regardless of the power being provided to the propeller shaft. More specifically, the rotation of the pump shaft may be directly related to the rotation of the crankshaft. Consequently, as the rotational speed of the crankshaft increases, the rotational speed of the pump shaft also increases. Accordingly, as the rotational speed of the crankshaft decreases, the rotational speed of the pump shaft also decreases. This ensures that suitable flow rates of oil are delivered to the oil reservoir, in use.

The pump shaft may be laterally spaced apart from the input drive shaft. Alternatively, or in addition, the pump shaft may be laterally spaced apart from the output drive shaft and/or second intermediate shaft. Laterally spacing apart the pump shaft and the input shaft may improve the overall packaging of the system. Furthermore, laterally spacing apart the pump shaft and the input shaft may enable the weight distribution of the outboard propulsion system to be optimised. The pump shaft and the input shaft may be substantially parallel.

In some embodiments, the pump shaft may be operably coupled to a forward clutch shaft. More specifically, the pump shaft may be operably coupled to a forward clutch shaft via a spinal hex coupling. Consequently, the forward clutch shaft and the pump shaft may be, at least in part, concentric and/or coaxial.

The outboard propulsion system may further comprise a lip seal configured to provide a substantially fluid-tight seal between the transmission assembly and the engine. More specifically, the lip seal may be configured to provide a substantially fluid-tight seal between the transmission assembly and the engine. Most specifically, the lip seal may be configured to provide a substantially fluid-tight seal between the transmission assembly and the crankcase. Consequently, the lip seal prevents oil within the engine and/or crankcase from entering the transmission assembly. More specifically, the outboard propulsion system may comprise a plurality of lip seals configured to provide a substantially fluid-tight seal between the transmission assembly and the engine.

As previously disclosed, the outboard propulsion system may further comprise a first portion for attachment to a boat. The first portion may comprise the engine. The first portion may further comprise the crankcase and the crankshaft. The first portion may also comprise the oil pan, oil reservoir, and/or transmission assembly.

The outboard propulsion system may further comprise a drop shaft operably connected between the transmission assembly and the propeller shaft. The drop shaft may be substantially perpendicular to the propeller shaft. The outboard propulsion may comprise an output drive shaft operably connected between the transmission assembly and the drop shaft. The output drive shaft may be operably connected to the drop shaft via a first bevel gear.

The crankshaft may have a longitudinal axis along its elongate length. The drive shaft may be substantially parallel to the crankshaft longitudinal axis. The steering axis may extend substantially parallel to the longitudinal axis of the crankshaft. Alternatively, or in addition, the outboard propulsion system may comprise a turbocharger. A turbocharger may increase the power generated by the engine and/or reduce the amount of waste produced.

The turbocharger may be located at the back of the engine, in use. Consequently, the turbocharger may be located aft of the engine, in use. For example, the engine may be located between the turbocharger and the boat, in use. Alternatively, or in addition, the engine may be located between the turbocharger and the oil reservoir.

The turbocharger may be configured to receive oil. More specifically, the turbocharger may be configured to receive oil from the oil reservoir. Oil may be pumped from the oil reservoir to the turbocharger by the oil supply pump. Oil may be supplied to the turbocharger in order to lubricate bearings within the turbocharger. Moreover, the turbocharger may comprise a drain configured to remove excess oil from within the turbocharger. The drain may be in fluid communication with the oil reservoir. More specifically, the drain may be in fluid communication with the oil reservoir via the oil transfer pump. By connecting the drain to the oil transfer pump, oil may be drawn out of the turbocharger, thus preventing oil build-up within the turbocharger and consequently preventing unwanted pressure from building up within the turbocharger. Moreover, the limited oil pressure within the turbocharger prevents oil from leaking past the seals and entering the exhaust system, thus protecting the engine from potential damage and preventing a phenomenon known as engine 'run away'.

Consequently, by connecting the turbocharger oil drain to the oil transfer pump, the location of the turbocharger may be optimised as gravity is not relied upon to remove oil from within the turbocharger. For example, the lowest point of the turbocharger may be located less than 300 mm above the lowest point of the oil pan, in use. More specifically, the lowest point of the turbocharger may be located less than 250 mm above the lowest point of the oil pan, in use. Most specifically, the lowest point of the turbocharger may be located less than 200 mm above than the lowest point of the oil pan, in use. For example, the lowest point of the turbocharger may be located between 0-300 mm, 100-250 mm, 150-200 mm or 160-190 mm above than the lowest point of the oil pan, in use. In this context, 'above' means at a higher elevation with respect to substantially horizontal plane and/or in a direction opposing gravity.

The turbocharger may be in fluid communication with the oil reservoir via a turbocharger oil conduit. More specifically, an oil supply pump may be configured to pump oil from the oil reservoir to the turbocharger via the turbocharger oil conduit.

Installing the turbocharger at the back of the engine (i.e. behind both the boat and the engine, in use) enables the oil therein to drain into an oil pick-up under gravity and be pumped back to the oil reservoir, within a separate conduit, by the oil supply pump. The use of a pump to assist the flow of oil generated by gravity significantly reduces the height above the oil pan with which the turbocharger needs to be located. This results in a more efficiently packaged system that can efficiently incorporate the use of a turbocharger. Moreover, supplying the turbocharger with oil from within the oil reservoir instead of the oil pan ensures that the turbocharger can constantly receive oil, in use, even when the boat is performing a sharp turn, for example.

The invention will now be further and more particularly described, by way of example only, and with reference to the accompanying drawings in which.

Figure 1:
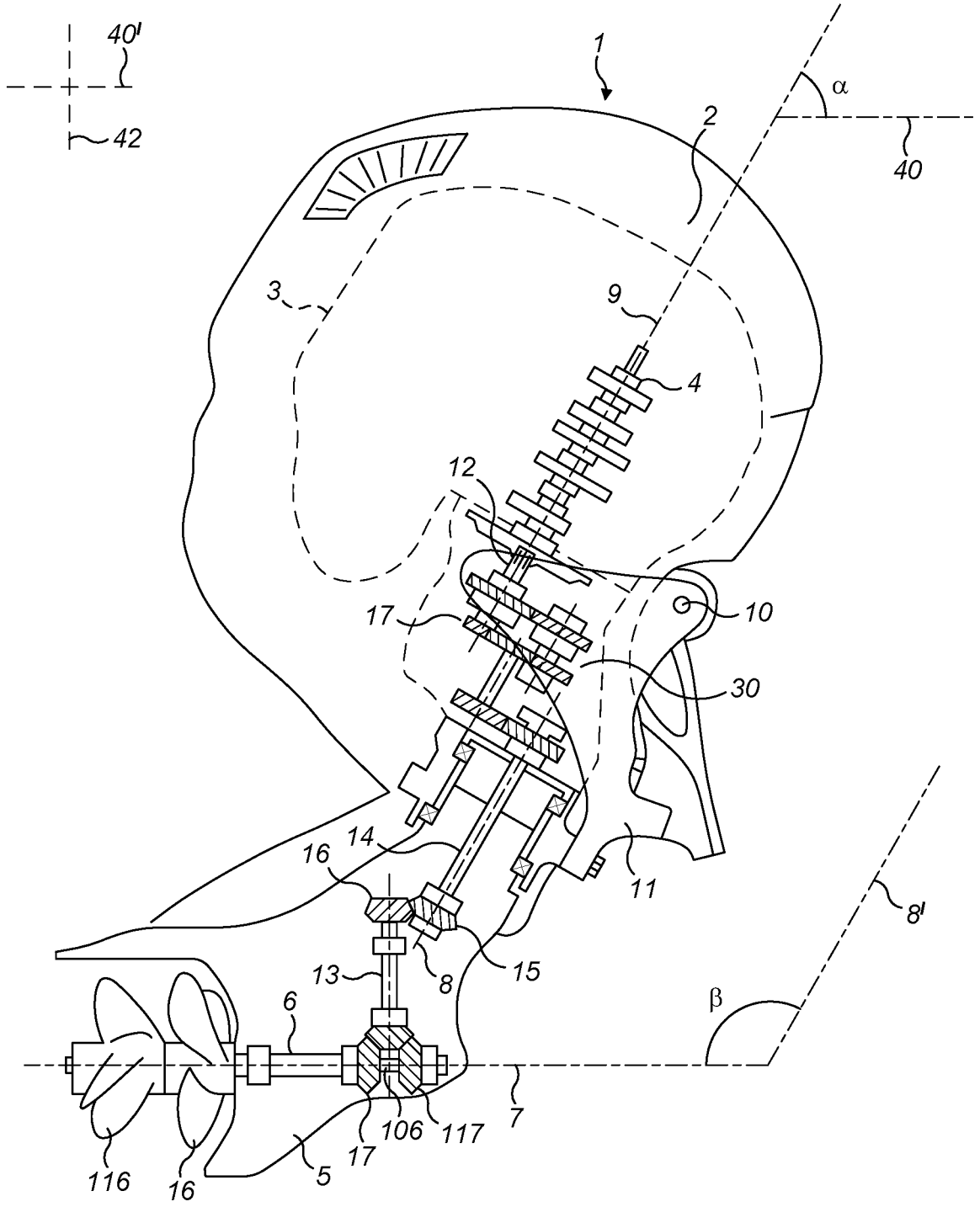
FIG. 1 is a schematic of the outboard propulsion system according to the present invention.

FIG. 1 shows an embodiment of the outboard propulsion system 1 comprising a first portion 2 and second portion 5. The first portion 2 comprises an engine 3 including a crankshaft 4. The engine 3 is configured to produce and transfer motive power to the crankshaft 4. In some embodiments, the engine 3 may be a traditional four-stroke compression ignition diesel engine. However, any internal combustion engine may be used. In some embodiments, the engine is diesel, whereas in other embodiments the engine is petrol. In some embodiments, the engine is a hybrid and comprises at least one battery and at least one electric motor. In some embodiments, not shown, the outboard propulsion system is electric and comprises at least one electric motor and an output shaft instead of an engine and crankshaft.

The longitudinal axis 9 of the crankshaft 4 is parallel to the steering axis 8. The steering axis 8 and the longitudinal axis of the crankshaft 9 intersect a longitudinal axis of the boat 40 at an acute angle $\alpha$ of approximately 60 degrees. In some embodiments, not shown, the longitudinal axis of the crankshaft may intersect the longitudinal axis of the boat at an acute angle $\alpha$ between 0-90 degrees, 20-85 degrees, 40-80 degrees, 50-70 degrees, 55-55 degrees or at approximately 60 degrees. Furthermore, the second portion 5 comprises an outer propeller shaft 6 and an inner propeller shaft 106 having a longitudinal axis 7 along the elongate length of the shaft.

The crankshaft 4 is operably connected to a first intermediate shaft 12 via a spline joint. The first intermediate shaft 12 is operably connected to a transmission assembly 30. The transmission assembly 30 is operably connected to a second intermediate shaft 14 which is operably connected to a drop shaft 13 via a bevel gear 15. The first 12 and second 14 intermediate shafts are substantially parallel to the crankshaft 4. The drop shaft 13 is operably connected to the outer propeller shaft 6 via a first 90 degree bevel gear 17, hence completing the transfer of motive power between the crankshaft 4 and the outer propeller shaft 6. Furthermore, the drop shaft 13 is operably connected to the inner propeller shaft 106 via a second 90 degree bevel gear 117, hence completing the transfer of motive power between the crankshaft 4 and the inner propeller shaft 106.

Alternatively, in some embodiments (not shown), the first intermediate shaft 12 or second intermediate shaft 14 may be directly connected to the outer propeller shaft 6 via a first bevel gear configured to transmit motive power therebetween. The first intermediate shaft 12 or second intermediate shaft 14 may also be directly connected to the inner propeller shaft 106 via a second bevel gear configured to transmit motive power therebetween.

In some embodiments, not shown, there may be a single propeller shaft and the first intermediate shaft 12 or second intermediate shaft 14 may be directly connected to the propeller shaft via a bevel gear configured to transmit motive power therebetween.

Alternatively, in some embodiments (not shown), the crankshaft 4 may be directly connected to the at least one propeller shaft via a bevel gear configured to transmit motive power therebetween. For example, the crankshaft 4 may extend out of the engine 3, through the first portion 2, into the second portion 5 and connect to the at least one propeller shaft via at least one bevel gear.

As shown in FIG. 1, the plurality of drive shafts comprises a drop shaft 13, a first intermediate shaft 12 and a second intermediate shaft 14. The drop shaft 13 is substantially perpendicular to the outer 6 and inner 116 propeller shafts and is configured to transmit motive power from the crankshaft 4 to the inner 106 and outer 6 propeller shafts.

The second intermediate shaft 14 is operably connected between the first intermediate shaft 12 and the drop shaft 13. The second intermediate shaft 14 is substantially parallel to a longitudinal axis of the crankshaft 9 and is operably connected to the drop shaft 13 via a bevel gear 15.

The second portion 5 is configured to pivot relative to the first portion 2 about the steering axis 8. The steering axis 8 extends substantially parallel to the longitudinal axis of the crankshaft 9 and intersects the longitudinal axis of the propeller shafts 7 at an obtuse angle β between 100 degrees and 140 degrees. The axis 8' is parallel to and offset from the steering axis in FIG. 1 and has been used to demonstrate the obtuse angle β for clarity. Preferably, the steering axis 8 (and offset axis 8') intersect the longitudinal axis of the propeller shafts 7 at an angle β of about 120 degrees.

Furthermore, the outer propeller shaft 6 comprises a first propeller 16 configured to receive motive force from the outer propeller shaft 6 and generate thrust to drive the boat through a fluid, such as water, in use. The inner propeller shaft 106 comprises a second propeller 116 configured to receive motive force from the inner propeller shaft 106 and generate thrust to drive the boat through a fluid, such as water, in use.

In some embodiments, not shown, the inner and/or outer propeller shaft comprise a plurality of propellers.

The outboard propulsion system further comprises a transmission assembly 30 configured to control the motive power provided to the propeller shafts.

Figure 2:
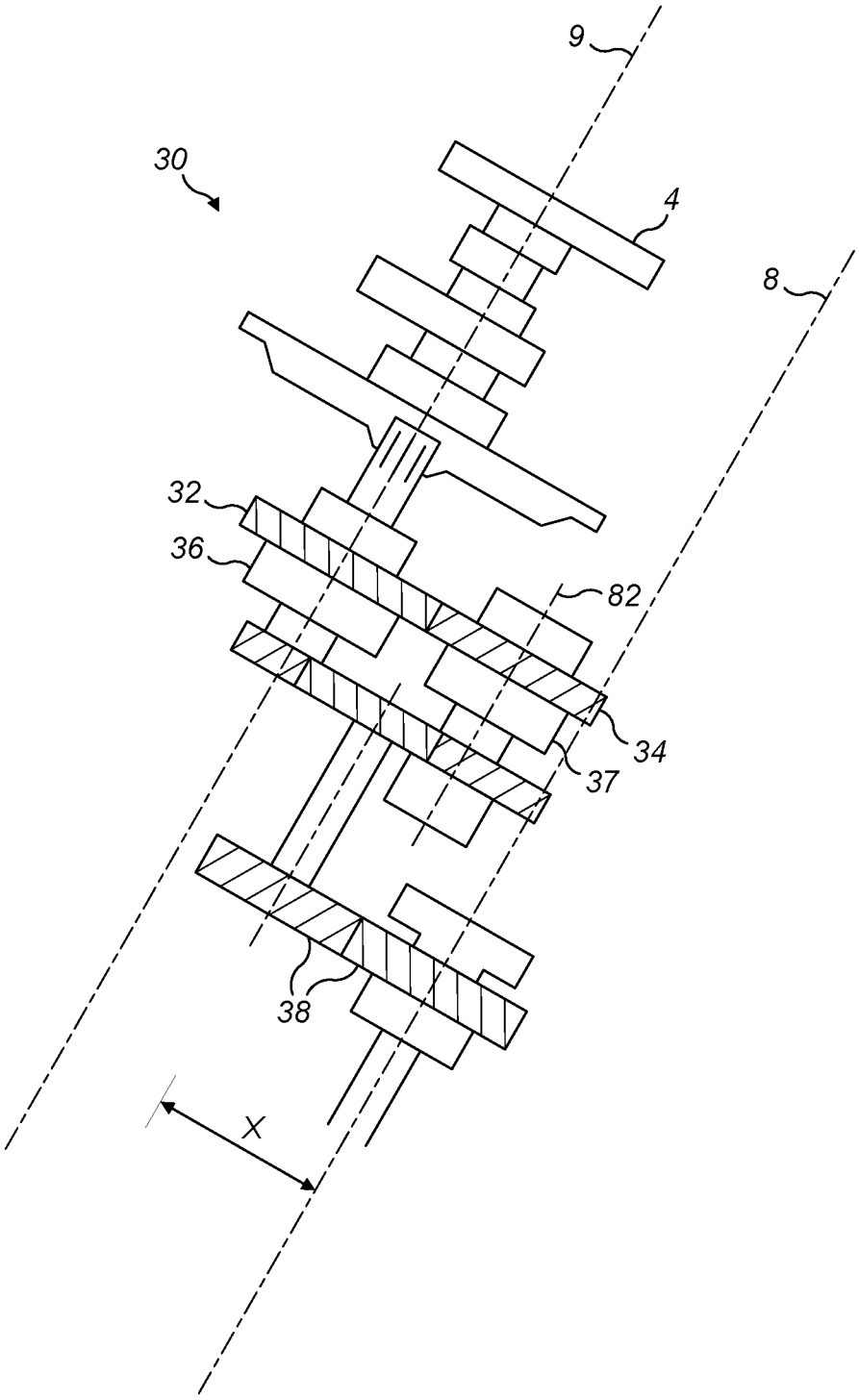
FIG. 2 shows an example transmission assembly of the present invention, as shown in FIG. 1.

FIG. 2 shows a transmission assembly of the present invention. The transmission assembly 30 comprises a forward gear set 34 and a reversing gear 32 configured to control the speed and/or direction of motive power transferred to the propeller shafts. The transmission assembly also comprises a forward clutch 37 configured to enable the forward gear set 34 and a reversing clutch 36 configured to enable the reversing gears to be engaged interchangeably. The transmission assembly 30 is located in the first portion 2. However, in some embodiments (not shown), the transmission assembly may be located in the second portion 5.

Furthermore, the transmission assembly comprises an offset pair of offset gears 38 configured to move the second portion closer to the stern of the boat by a distance X. The distance X is approximately 105-110 mm, for example 107 mm. In some embodiments, not shown, X may be 0-1000 mm, 20-500 mm, 50-300 mm, 70-200 mm, 80-150 mm or 100-120 mm.

Figure 3:
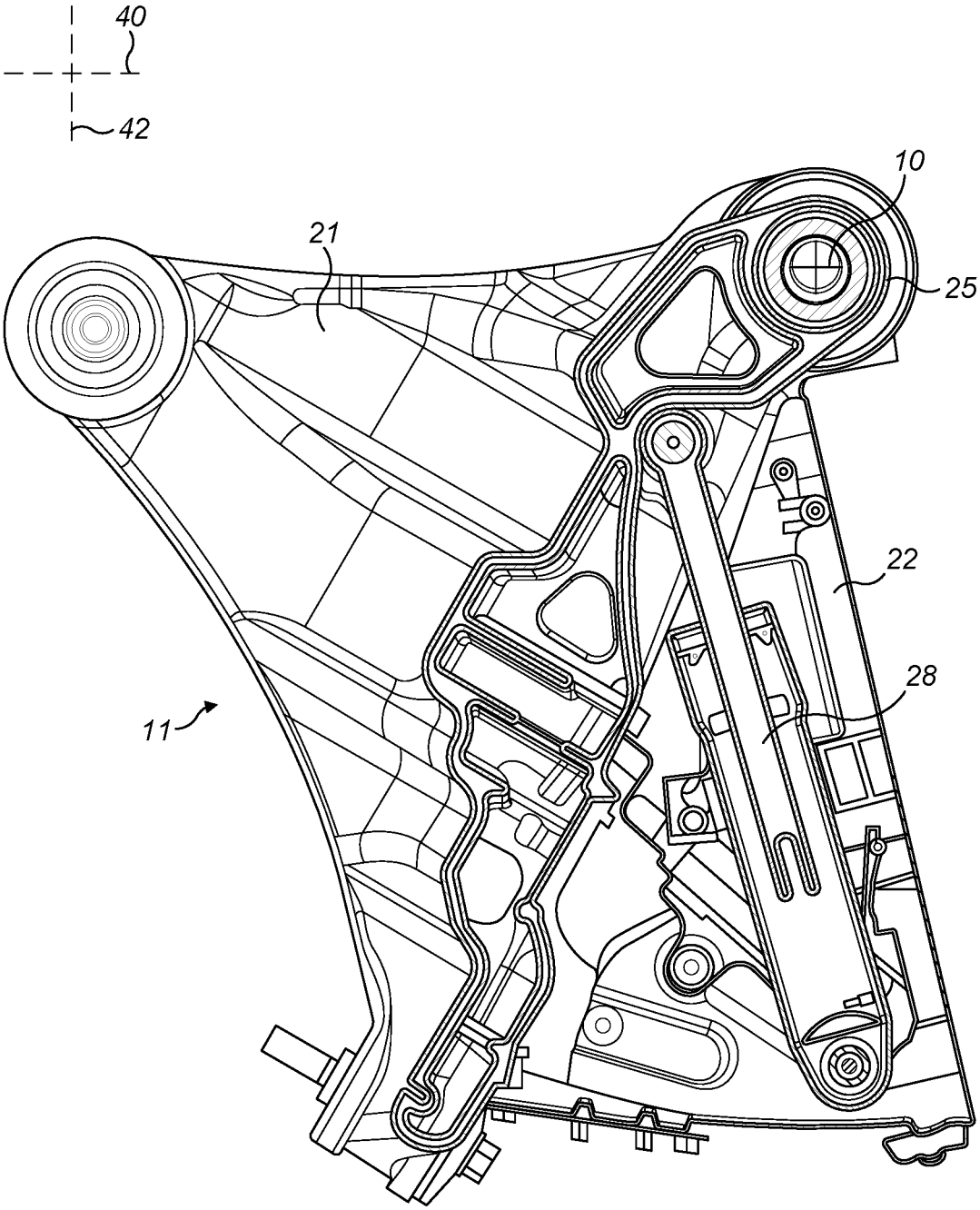
FIG. 3 is a section through an example fixing mechanism for attaching the outboard propulsion system to a stern of a boat.

FIG. 3 shows a section through the fixing mechanism 11, wherein the section is taken through a plane parallel to the longitudinal axis of the boat 40 and approximately 5 to 250 mm from a side elevation of the fixing mechanism. The fixing mechanism 11 is configured to attach the first portion of the outboard propulsion system to the transom of a boat. Furthermore, the fixing mechanism is configured to tilt the first portion 2 and second portion 5 together about a single axis of rotation 10 substantially parallel to the stern of the boat.

The fixing mechanism 11 comprises a cradle 21 for attachment to the first portion 2 and a transom bracket 22 for attachment to the transom of the boat. The cradle 21 is fixed to the first portion 2 via a plurality of bolts configured to prevent relative movement therebetween. The cradle is bolted to the housing of the transmission assembly 30. The first portion is therefore fixed about a substantially vertical axis 42. In some embodiments, not shown, the first portion may be fixed about a substantially vertical plane.

The transom bracket 22 is configured to attach to the stern of the boat via a plurality of bolts, screws and/or clamps configured to pass through the transom bracket and the transom of the boat to couple the two components together. The cradle 21 and transom bracket 22 are operably connected via a rotatable joint 25 configured to permit the single axis of rotation 10 substantially parallel to the stern of the boat.

The rotatable joint 25 shown in the FIG. 3 section comprises a single rotatable joint. In some embodiments (not shown), the full fixing mechanism 11 may comprise at least two separate coaxial rotatable joints. Each rotatable joint comprises a spindle less than 500 mm long. More preferably, the spindle may be less than 400 mm, 300 mm or 200 mm long and most preferably the spindle is less than 100 mm long, for example 65 mm.

The fixing mechanism 11, as shown in the FIG. 3 section, further comprises a hydraulic arm 28 operably connected between the cradle 21 and transom bracket 22. The hydraulic arm 28 is configured to rotate the cradle relative to the transom bracket, hence rotating the outboard propulsion system 1 relative to the transom of the boat about the axis of rotation 10. This rotation may be used to trim and/or tilt the outboard propulsion system. In some embodiments (not shown), the full fixing mechanism may comprise a second hydraulic arm located on the opposing side of the fixing mechanism such that the fixing mechanism is symmetrical about a vertical axis. The second hydraulic arm may assist with trimming and/or tilting a heavy marine propulsion system and/or enabling two smaller hydraulic arms to replace one larger component. Furthermore, in some embodiments (not shown, the fixing mechanism may comprise a plurality of hydraulic arms, comprising up to, 2, 3, 4, 5, 8, 10 or more than 10 hydraulic arms.

The hydraulic arm(s) 28 is operably connected to an electronic control unit configured to expand and contract the hydraulic arm to control the movement of the cradle relative to the transom bracket. The control unit may be operated by a user, such as a captain, driver and/or crew member of the boat.

Figure 4:
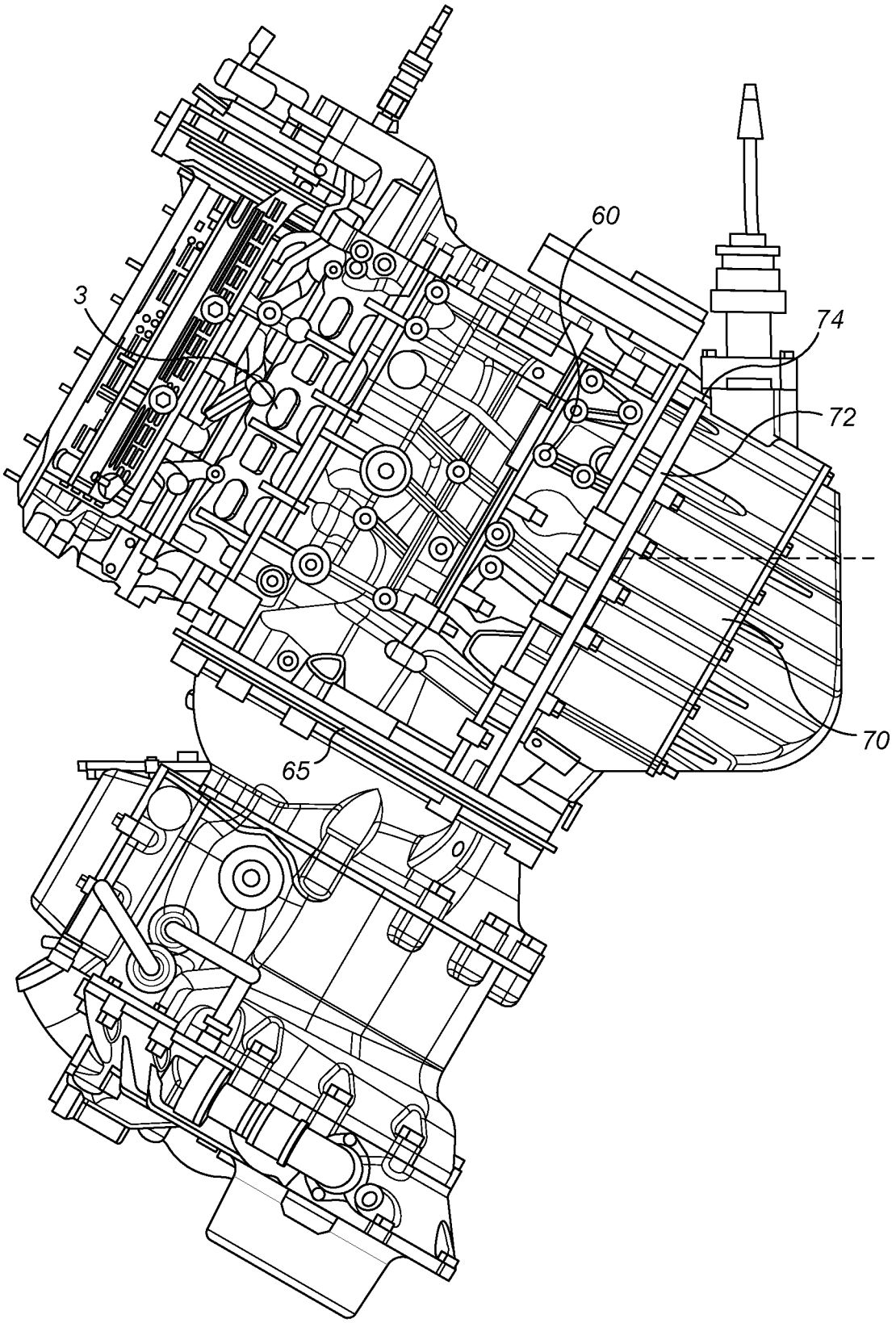
FIG. 4 shows an outboard propulsion system comprising an engine, an oil pan and an oil reservoir.

FIG. 4 shows the outboard propulsion system 1 including an engine 3 having a crankcase 60 comprising the crankshaft 4. The outboard propulsion system 1 further comprises an oil pan 65 and an oil reservoir 70. The engine 3 is configured to receive oil from the oil reservoir 70. In use, an oil transfer pump 80 pumps oil from the oil pan 65 into the oil reservoir 70 via at least one conduit. In addition, an oil supply pump, not shown in the accompanying drawings, pumps oil from the oil reservoir 70 into the engine 3 via at least one conduit. The oil supply pump is powered via a chain or belt operably connected to the crankshaft 4. Therefore, as the rotational speed of the crankshaft 4 increases, the oil supply pump receives more rotational energy, thus increasing the volume of oil supplied to the engine per unit of time. Alternatively, in some embodiments, the oil supply pump is operably connected to a pump shaft 82, thus receiving power therefrom.

Excess oil within the engine 3 is collected in the oil pan 65. The oil pan 65 is located substantially below the engine 3, in use. More specifically, the oil pan 65 is located substantially below the crankcase 60, in use. Consequently, oil within the engine and/or crankcase flows towards to oil pan under gravity. Oil within the oil pan 65 is then transferred into the oil reservoir 70 via the oil transfer pump 80, in use.

In some embodiments, the outboard propulsion system 1 further comprises an oil filter. The oil filter is positioned such that oil flowing from the oil reservoir 70 to the engine 3 passes through the filter. The filter is configured to remove contaminants, such as metal particles, from with the oil. This again increases the efficiency with which the engine can generate power. The outboard propulsion system 1 further comprises an oil cooler. The oil cooler is located between the oil reservoir 70 and the oil filter. More specifically, the oil cooler is located between the oil supply pump and the oil filter. Consequently, oil flowing from the reservoir 70 to the engine 3 is cooled and then filtered.

The oil reservoir 70 comprises an oil pick-up configured to receive oil and transfer it into the engine. The oil pick-up is in fluid communication with the engine 3 via at least one conduit. More specifically, the oil pick-up is in fluid communication with the engine 3 via the oil supply pump. Preferably, the oil pick-up is located towards the bottom of the oil reservoir 70. Locating the oil pick-up towards the bottom of the oil reservoir, in use, ensures that it remains submerged in oil, in use. This is particularly advantageous when the outboard propulsion system is rotated away from a horizontal plane, such as when turning a corner.

The oil reservoir 70 is located fore of the engine, as shown in FIG. 4. Therefore, in use, the oil reservoir 70 is located between the engine 3 and the boat. Alternatively, in some embodiments, the oil reservoir is located behind the engine or above the engine. Accordingly, the oil reservoir 70 may be located in any desirable position.

More specifically, the oil reservoir is located directly adjacent to the engine, as shown in FIG. 4. For example, the oil reservoir may be positioned in order to optimise the weight distribution of the outboard propulsion system and/or to improve the overall packaging of the system.

In some embodiments, the engine 3 comprises an internal wall 72 configured to separate the crankcase 60 from the oil reservoir 70. Consequently, a boundary of each of the crankcase 60 and the oil reservoir 70 is defined by the internal wall 72. The internal wall 72 further comprises an aperture 74 configured to balance pressure between the crankcase 60 and the oil reservoir 70. The aperture 74 is located towards the top of the oil reservoir 70, in use. Consequently, the aperture 72 and the oil pick-up are located at opposing ends of the oil reservoir 70.

Figure 5:
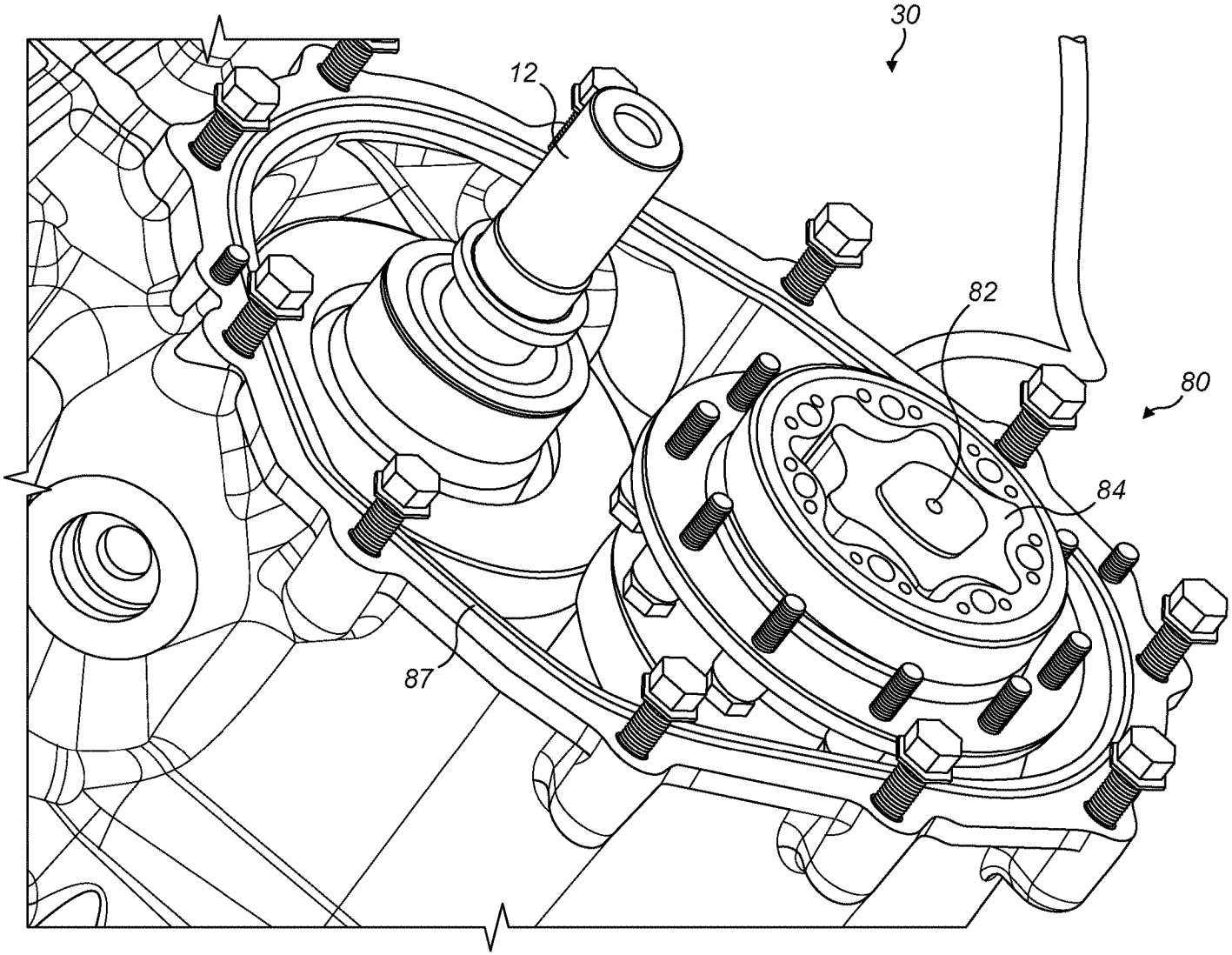
FIG. 5 shows an outboard transmission assembly comprising an oil transfer pump.

FIG. 5 shows an outboard transmission assembly 30 comprising an oil transfer pump 80. The oil transfer pump 80 is configured to receive motive power, in the form of rotational energy, directly from the transmission assembly 30. More specifically, the engine 3 causes the crankshaft 4 to rotate about its longitudinal axis, which, in turn, causes the first intermediate shaft 12 and/or input shaft 12 to rotate. The oil transfer pump 80 comprises a pump shaft 82 which is coupled to the first intermediate shaft 12 and/or the input shaft. More specifically, the first intermediate shaft 12 and/or the input shaft is directly coupled to the reverse gear 32 and the reverse clutch 36, and the pump shaft 82 is directly coupled to the forward gear 34 and the forward clutch 37. Alternatively, in some embodiments, the pump shaft 82 is directly coupled to the first intermediate shaft 12 and/or the input shaft. However, in some embodiments, the pump shaft 82 is coupled to the first intermediate shaft 12 and/or the input shaft via at least one additional shaft.

The pump shaft 82 is configured to rotate constantly, in use. For example, the pump shaft is configured to rotate constantly when the engine 3 is turned on. More specifically, the pump shaft 82 is operably coupled to the crankshaft 4. Consequently, as the rotational speed of the crankshaft increases, the rotational speed of the pump shaft increases. However, there may be at least one gear configured to increases and/or decrease the rotational speed of the pump shaft 82 with respect to the crankshaft 4. Nevertheless, as the rotational speed of the crankshaft 4 increases, the pump shaft rotational speed increases, thus increasing the rate at which of oil is transferred from the oil pan 65 to the oil reservoir 70.

The engine, crankcase, oil pan, oil reservoir, turbocharger and conduits therebetween may comprise between 3 and 20 litres of oil in total. More specifically, the engine, crankcase, oil pan, oil reservoir, turbocharger and conduits therebetween may comprise between 5-15 litres of oil in total. Most specifically, the engine, crankcase, oil pan, oil reservoir, turbocharger and conduits therebetween may comprise between 7 and 11 litres of oil in total. For example, in some embodiments, the engine, crankcase, oil pan, oil reservoir, turbocharger and conduits therebetween comprises between 8 and 10 litres of oil in total.

In some embodiments, in use, the engine receives between 30 and 150 litres of oil per minute. More specifically, the engine receives between 35 and 60 litres of oil per minute. Most specifically, the engine receives between 40 and 45 litres of oil per minute. The oil supply pump is configured to deliver the aforementioned oil flow rates to the engine via a conduit. Alternatively, in some embodiments, the oil transfer pump 80 may pump up to 1,000 litres of fluid per minute from the oil pan to the oil reservoir. The fluid may comprise air and oil.

Alternatively, or in addition, the oil transfer pump 80 is configured to pump between 100 and 140 litres of oil per minute from the oil pan 65 to the oil reservoir 70. More specifically, the oil transfer pump 80 is configured to pump between 110 and 130 litres of oil per minute from the oil pan 65 to the oil reservoir 70. Most specifically, the oil transfer pump 80 is configured to pump between 115 and 125 litres of oil per minute from the oil pan 65 to the oil reservoir 70. Consequently, the oil transfer pump 80 may pull air from within the engine and deliver it to the oil reservoir 70. Consequently, the oil transfer pump 80 may be configured to generate a partial vacuum within the engine 3.

In some embodiments, the oil transfer pump 80 is configured to generate a partial vacuum within the crankcase 60. This ensures that substantially all of the oil within the crankcase is emptied into the oil reservoir 70 when engine 3 is turned off. The air pressure within the crankcase may be less than 1 bar, in use. More specifically, the air pressure within the crankcase may be less than 0.75 bar, in use. Most specifically, the air pressure within the crankcase may be less than 0.5 bar, in use. However, in some embodiments, the air pressure within the crankcase is less than 0.4 bar, in use.

The partial vacuum within the engine and/or crankcase reduces the air resistance on the crankshaft as it rotates, in use. Moreover, the partial vacuum within the crankcase also prevents excess oil within the crankcase from coming into contact with the crankshaft, in use. This may improve the efficiency of the engine by up to 3%.

Figure 6A:
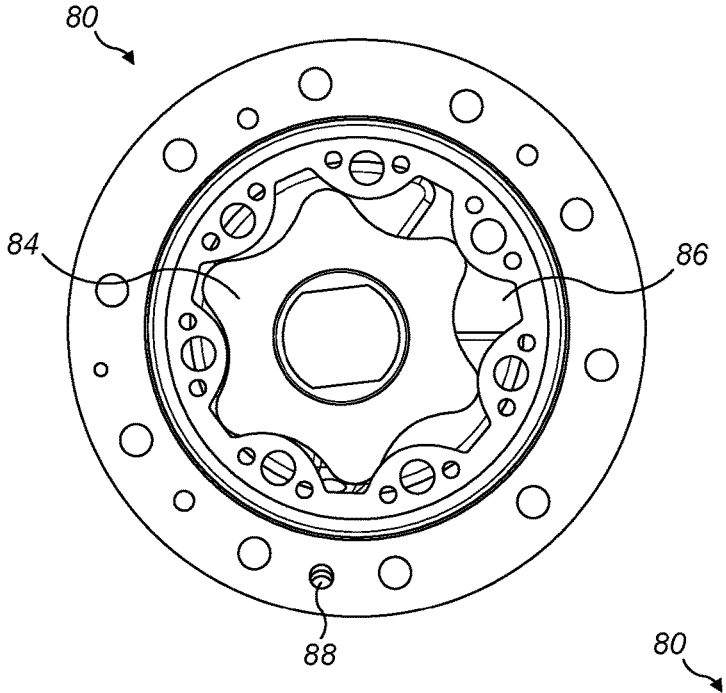
FIG. 6A shows the oil transfer pump when viewed from above.
Figure 6B:
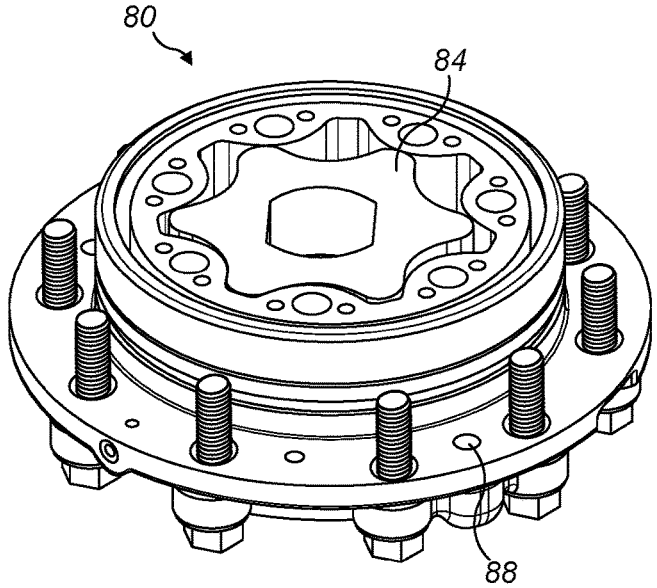
FIG. 6B shows the top and side view of the oil transfer pump.
Figure 6C:
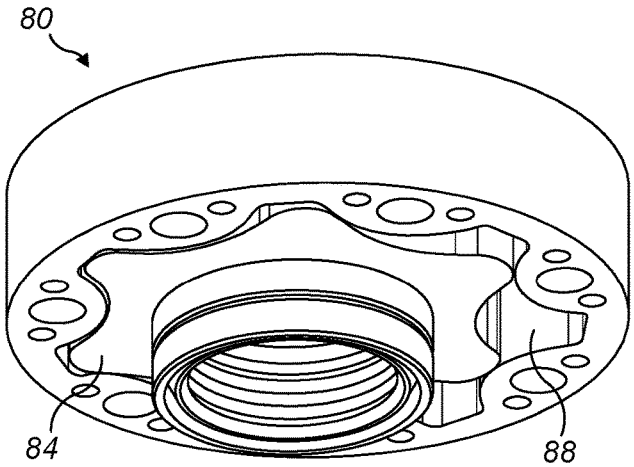
FIG. 6C shows the bottom and side view of the oil transfer pump.

FIG. 6A shows the oil transfer pump 80 when viewed from above; FIG. 6B shows the top and side view of the oil transfer pump 80; and FIG. 6C shows the bottom and side view of the oil transfer pump 80.

More specifically, the oil transfer pump 80 comprises a rotor 84 configured to transfers the oil from an inlet port to an outlet port within the transfer pump 80. The rotor 84 is a dual filled rotor. Consequently, the oil transfer pump 80 comprises a first inlet 86 configured to receive oil from the oil pan 65. The first inlet 86 is located at a first end of the oil transfer pump 80. More specifically, the first inlet 86 is located at a first end of the rotor 84. For example, the first inlet 86 is located towards the top of the oil transfer pump 80, in use. The oil transfer pump 80 further comprises a second inlet 88 configured to receive oil from the turbocharger. The second inlet 88 is located at a second end of the oil transfer pump 80. More specifically, the second inlet 88 is located at a second end of the rotor 84. For example, the second inlet 88 is located towards the bottom of the oil transfer pump 80, in use. Accordingly, the first and second end of the oil transfer pump are opposing ends. More specifically, the first inlet 86 is positioned at the top on the oil transfer pump and the second inlet 88 is positioned at the bottom of the oil transfer pump. The oil transfer pump 80 further comprises an outlet position between the first inlet and the second inlet. The outlet is in fluid communication with the oil reservoir 70. Consequently, the turbocharger drain, oil pump inlet, oil pump outlet and corresponding oil conduits can be sized in order to optimise the engine performance.

The outboard propulsions system further comprises a seal 87 configured to provide a substantially fluid-tight seal between the transmission assembly and the engine. More specifically, the outboard propulsions system further comprises a seal 87 configured to provide a substantially fluid-tight seal between the transmission assembly and the engine 3. Most specifically, the outboard propulsions system further comprises a seal 87 configured to provide a substantially fluid-tight seal between the transmission assembly and the crankcase 60. The seal 87 is a lip seal. However, any suitable seal may be used.

Various further aspects and embodiments of the present invention will be apparent to those skilled in the art in view of the present disclosure.

"and/or" where used herein is to be taken as specific disclosure of each of the two specified features or components with or without the other. For example, "A and/or B" is to be taken as specific disclosure of each of (i) A, (ii) B and (iii) A and B, just as if each is set out individually herein.

Unless the context dictates otherwise, the descriptions and definitions of the features set out above are not limited to any particular aspect or embodiment of the invention and apply equally to all aspects and embodiments that are described.

It will further be appreciated by those skilled in the art that, although the invention has been described by way of example with reference to several embodiments, the invention is not limited to the disclosed embodiments and that alternative embodiments could be constructed without departing from the scope of the invention as defined in the appended claims.

The invention claimed is:

1. An outboard propulsion system comprising:

a first portion for attachment to a boat, wherein the first portion comprises:

an engine configured to receive oil;

an oil pan configured to receive oil from the engine; and an oil reservoir configured to receive oil from the oil pan and provide oil to the engine, in use; and a second portion attached to the first portion, wherein the second portion comprises a propeller shaft operably connected to a crankshaft within the engine;

wherein the second portion is configured to pivot relative to the first portion about a steering axis that extends substantially parallel to a longitudinal axis of the crankshaft, and wherein the oil reservoir is located fore of the engine such that the oil reservoir is positioned between the engine and a transom of a boat, in use.

2. The outboard propulsion system according to claim 1, further comprising a transmission assembly having an oil transfer pump, wherein the oil transfer pump is configured to pump oil from the oil pan to the oil reservoir.

3. The outboard propulsion system according to claim 2, wherein the oil transfer pump is configured to receive motive power directly from the transmission assembly.

4. The outboard propulsion system according to claim 3, wherein the transmission assembly is configured to receive motive power from the engine via at least one drive shaft and provide motive power to the oil transfer pump via a pump shaft located within the transmission assembly.

5. The outboard propulsion system according to claim 4, wherein the at least one drive shaft comprises an input drive shaft, and wherein the pump shaft is operably coupled to a crankshaft located within the engine via the input drive shaft.

6. The outboard propulsion system according to claim 5, wherein the pump shaft is laterally spaced apart from the input drive shaft.

7. The outboard propulsion system according to claim 2, further comprising a lip seal configured to provide a substantially fluid-tight seal between the transmission assembly and the engine.

8. The outboard propulsion system according to claim 1, wherein the propeller shaft has a longitudinal axis along its elongate length and wherein the steering axis intersects the longitudinal axis of the propeller shaft at an obtuse angle.

9. The outboard propulsion system according to claim 1, wherein the first portion and second portion are configured to tilt together about a single axis of rotation substantially parallel to a stern of the boat.

10. The outboard propulsion system according to claim 1, wherein the first portion is fixed about a substantially vertical axis.

11. The outboard propulsion system according to claim 1, further comprising a fixing mechanism configured to attach the first portion to a stern of the boat, wherein the fixing mechanism is configured to permit only a single axis of rotation.

12. The outboard propulsion system according to claim 4, further comprising a drop shaft operably connected between the transmission assembly and the propeller shaft, wherein the drop shaft is substantially perpendicular to the propeller shaft.

13. The outboard propulsion system according to claim 12, further comprising an output drive shaft operably connected between the transmission assembly and the drop shaft.

14. The outboard propulsion system according to claim 13, wherein the output drive shaft is operably connected to the drop shaft via a first bevel gear.

15. The outboard propulsion system according to claim 4, wherein the at least one drive shaft is substantially parallel to the crankshaft longitudinal axis.

16. The outboard propulsion system according to claim 2, wherein the transmission assembly is located in the first portion.

17. The outboard propulsion system according to claim 16, wherein the transmission assembly further comprises an offset pair of gears configured to move the second portion closer to a fixing mechanism configured to attach the first portion to a stern of the boat.

18. An outboard propulsion system comprising:

a first portion for attachment to a boat via a fixing mechanism, wherein the first portion comprises:

an engine configured to receive oil;

an oil pan configured to receive oil from the engine;

an oil reservoir configured to receive oil from the oil pan and provide oil to the engine, in use; and a transmission assembly; and a second portion attached to the first portion, wherein the second portion comprises a propeller shaft operably connected to a crankshaft within the engine;

wherein the transmission assembly comprises an offset pair of gears configured to move the second portion closer to the fixing mechanism.

19. An outboard propulsion system comprising:

a first portion for attachment to a boat comprising a stern, the first portion comprising an engine including a crankshaft;

a fixing mechanism configured to attached the first portion to the stern on the boat;

a second portion comprising at least one propeller shaft having a longitudinal axis along an elongate length of the at least one propeller shaft;

at least one drive shaft operably connected between the crankshaft and the at least one propeller shaft and configured to transmit motive power there between; and a transmission assembly configured to receive motive power from the engine via the at least one drive shaft and control the motive power provided to the at least one propeller shaft;

wherein the second portion is configured to pivot relative to the first portion about a steering axis;

wherein the steering axis intersects the longitudinal axis of the at least one propeller shaft at an angle between 90 and 180 degrees;

wherein the first portion and second portion are configured to tilt together about a single axis of rotation substantially parallel to the stern of the boat;

wherein the first portion is fixed about a substantially vertical axis; and wherein the transmission assembly comprising an offset pair of gears configured to move the second portion closer to the fixing mechanism.

* * * * *